US009764555B2

(12) United States Patent
Takenouchi et al.

(10) Patent No.: US 9,764,555 B2
(45) Date of Patent: Sep. 19, 2017

(54) INKJET PRINTER

(71) Applicant: Roland DG Corporation, Hamamatsu-shi, Shizuoka (JP)

(72) Inventors: Tsutomu Takenouchi, Hamamatsu (JP); Syunsuke Awaya, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/276,983

(22) Filed: Sep. 27, 2016

(65) Prior Publication Data

US 2017/0087848 A1 Mar. 30, 2017

(30) Foreign Application Priority Data

Sep. 28, 2015 (JP) ..... 2015-189279

(51) Int. Cl.
*B41J 2/165* (2006.01)
*B41J 2/14* (2006.01)

(52) U.S. Cl.
CPC ..... *B41J 2/16511* (2013.01); *B41J 2/14* (2013.01); *B41J 2/16508* (2013.01); *B41J 2/16523* (2013.01); *B41J 2/16552* (2013.01)

(58) Field of Classification Search
CPC .... B41J 2/165; B41J 2/16508; B41J 2/16505; B41J 2/16511; B41J 2/16523; B41J 2/16552; B41J 2002/16558; B41J 2002/16573
See application file for complete search history.

(56) References Cited

U.S. PATENT DOCUMENTS

2014/0292911 A1* 10/2014 Kajimoto ..... B41J 2/16535 347/29
2015/0336388 A1* 11/2015 Ohnishi ..... B41J 2/16552 347/28
2016/0152033 A1* 6/2016 Wakabayashi ..... B41J 2/16552 347/28

* cited by examiner

*Primary Examiner* — Geoffrey Mruk
*Assistant Examiner* — Scott A Richmond
(74) *Attorney, Agent, or Firm* — Keating & Bennett, LLP

(57) ABSTRACT

An inkjet printer includes a cap to forma sealed space between the cap and a nozzle surface when attached to an ink head so as to cover the nozzle surface, a cleaning solution tank to accommodate a cleaning solution to clean the cap, a motor to cause the cap to move between a capping position, at which the cap covers the nozzle surface, and a cleaning position, at which the cap sinks in the cleaning solution accommodated in the cleaning solution tank.

10 Claims, 7 Drawing Sheets

INKJET PRINTER

CROSS REFERENCE TO RELATED APPLICATIONS

The present application claims priority to Japanese Patent Application No. 2015-189279 filed on Sep. 28, 2015, which is hereby incorporated herein by reference in its entirety.

BACKGROUND OF THE INVENTION

1. Field of the Invention

The present invention relates to inkjet printers.

2. Description of the Related Art

Inkjet printers are well known, and are equipped with a plurality of nozzles to perform predetermined printing operations on a medium by an inkjet technique. Such an inkjet printer has a capping unit for allowing the nozzles to eject ink appropriately. The capping unit has a cap for covering a nozzle surface containing the nozzles when printing is not performed.

The capping unit forms a sealed space by covering the nozzle surface with the cap. This prevents the ink from drying out. With the sealed space formed, a suction pump connected to the capping unit is operated so that the ink with an increased viscosity and the dust that has adhered to the nozzles can be forcibly sucked out of the nozzles. This can prevent clogging of the nozzles.

When the ink adhering to the cap solidifies, the ink may cause the suction passage connecting the cap to the suction pump to clog up, or the ink firmly adhering to the cap may impede formation of the sealed space if the cap covers the nozzle surface. In order to solve such a problem, a cleaning solution is used to remove the ink adhering to the cap.

However, after the removal of the ink adhering to the cap using the cleaning solution, the cleaning solution may, in some cases, still remain on the cap. If the nozzle surface is covered by the cap under this condition, the cleaning solution may adhere to the nozzle surface. If printing is attempted with the cleaning solution adhering to the nozzle surface, the medium may be stained with the cleaning solution in printing.

SUMMARY OF THE INVENTION

In view of the foregoing and other problems, preferred embodiments of the present invention provide an inkjet printer that is able to reliably remove cleaning solution from a cap that has been cleaned with the cleaning solution and also prevent the cleaning solution from adhering to a nozzle surface of an ink head.

An inkjet printer according to a preferred embodiment of the present invention includes an ink head including a plurality of nozzles to eject ink and a nozzle surface in which the nozzles are provided; a cap attachable to and detachable from the ink head so as to cover the nozzle surface and to form a sealed space between the cap and the nozzle surface when attached to the ink head; a suction pump to suck out air contained in the sealed space; a cleaning solution tank to accommodate a cleaning solution to clean the cap; a driver causing the cap to move between a capping position, at which the cap covers the nozzle surface, and a cleaning position, at which the cap sinks in the cleaning solution accommodated in the cleaning solution tank.

An inkjet printer according to a preferred embodiment of the present invention includes the fan to blow air to the cap. Therefore, even if the cleaning solution adheres to the cap from which the ink has been removed by the cleaning solution, the cleaning solution adhering to the cap is removed by the air blown from the fan. As a result, when the cap is attached to the ink head so as to cover the nozzle surface, it is possible to form a sealed space and also prevent the cleaning solution from adhering to the nozzle surface.

Preferred embodiments of the present invention make it possible to provide an inkjet printer that is able to prevent the cleaning solution from adhering to the nozzle surface of the ink head by reliably removing the cleaning solution from the cap that has been cleaned with the cleaning solution.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinbelow, inkjet printers according to preferred embodiments of the present invention will be described with reference to the drawings. The preferred embodiments described herein are not intended to limit the present invention. The elements and components that exhibit the same effects are denoted by the same reference symbols, and repetitive description thereof may be omitted as appropriate.

Figure 1:
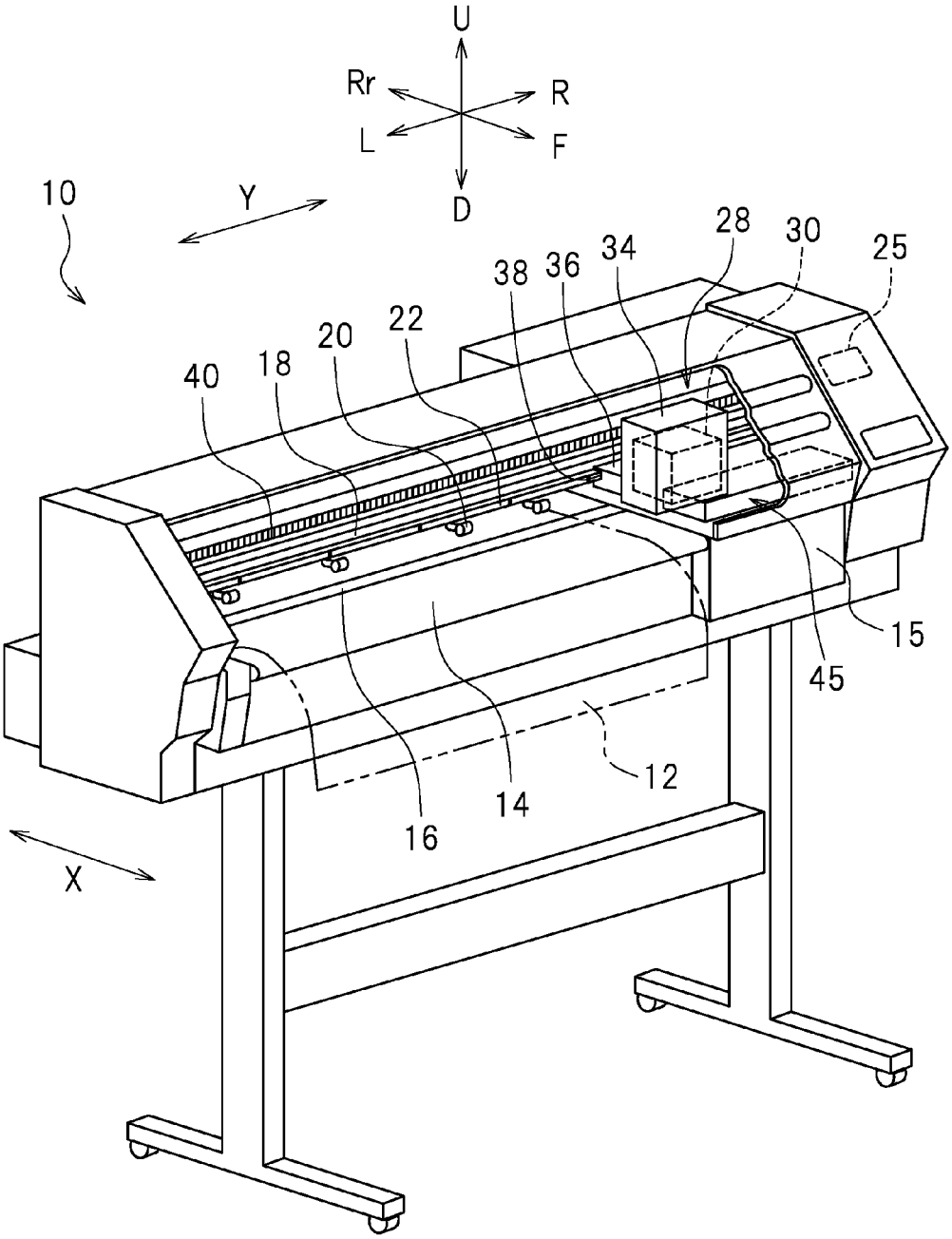
FIG. 1 is a perspective view illustrating an ink-jet printer, a portion of which is cut away, according to a preferred embodiment of the present invention.

FIG. 1 is a perspective view illustrating an inkjet printer 10, a portion of which is cut away, according to a preferred embodiment of the present invention. As illustrated in FIG. 1, the inkjet printer 10 performs printing on a medium 12. The medium 12 may be, for example, recording paper. The medium 12 is, however, not limited to the recording paper. For example, the medium 12 may be any other sheet-shaped medium, such as a resin sheet. The flexibility and the thickness of the medium 12 are not limited. In other words, the medium 12 may be a hard material, such as a glass substrate, or may be a thick material, such as a corrugated cardboard.

In the following description, the terms "left," "right," "up," and "down" respectively refer to left, right, up, and down as defined based on the perspective of the operator facing the inkjet printer 10. A direction toward the operator relative to the inkjet printer 10 is defined as "frontward," and a direction away from the operator relative to the inkjet printer 10 is defined as "rearward." Reference characters F, Rr, L, R, U, and D in the drawings represent front, rear, left, right, up, and down, respectively. A later-described ink head 30 is capable of moving leftward and rightward. The medium 12 is capable of being transferred frontward and rearward. In the present preferred embodiment, a direction in which the ink head 30 travels is referred to as a "main scanning direction Y", and a direction in which the medium 12 is transferred is referred to as a "sub-scanning direction X". Herein, the main scanning direction Y corresponds to a left-right direction, and the sub-scanning direction X corresponds to a front-rear direction. The main scanning direction Y and the sub-scanning direction X are orthogonal to each other. It should be noted, however, that the main scanning direction Y and the sub-scanning direction X are not particularly limited thereto, and may be set appropriately, for example, depending on the type of the inkjet printer 10. In addition, the inkjet printer 10 may also include, as a transport device, a device that moves a table that carries the medium thereon itself from side to side and back and forth.

As illustrated in FIG. 1, the inkjet printer 10 includes a platen 14 that supports the medium 12. The platen 14 is provided with a cylindrical grid roller 16, serving as a carriage mechanism. The grid roller 16 is buried in the platen 14 in such a manner that its upper surface is exposed. The grid roller 16 is driven by a feed motor 17 (see FIG. 2). The feed motor 17 is controlled by a later-described controller 25.

A guide rail 18 is disposed above the platen 14. The guide rail 18 is disposed parallel or substantially parallel to the platen 14. The guide rail 18 extends along a left-right direction. A plurality of pinch rollers 20 are disposed at regular or substantially regular intervals below the guide rail 18. The pinch rollers 20 are opposed to the grid roller 16. The pinch rollers 20 are positioned and structured such that their vertical positions are able to be set according to the thickness of the medium 12. The medium 12 is sandwiched between the pinch rollers 20 and the grid roller 16. The grid roller 16 and the pinch rollers 20 are capable of transporting the medium 12 in a sub-scanning direction X (i.e., a front-rear direction) while sandwiching the medium 12 therebetween. The guide rail 18 includes an engaging surface 22 protruding frontward.

Figure 3:
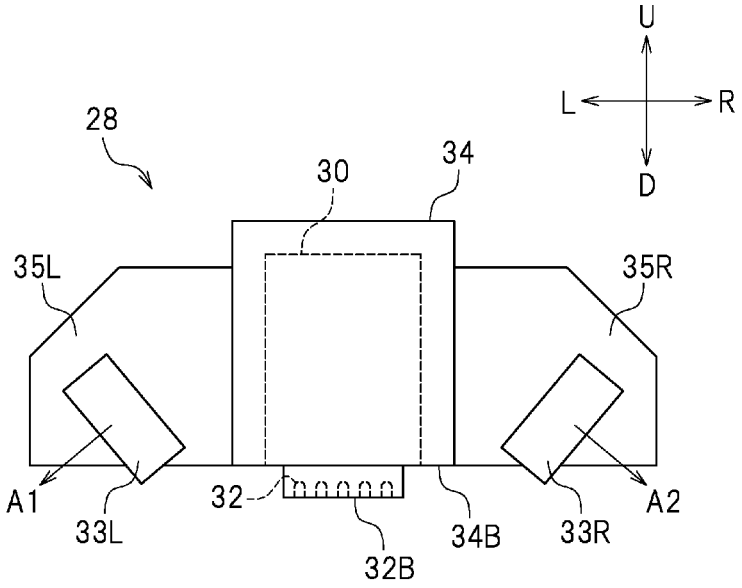
FIG. 3 is a front view illustrating an ink head assembly according to a preferred embodiment of the present invention.

As illustrated in FIG. 1, the inkjet printer 10 includes an ink head assembly 28. The ink head assembly 28 includes an ink head 30, a case 34, a later-described left fan 33L (see FIG. 3), and a later-described right fan 33R (see FIG. 3). The ink head 30 ejects ink onto the medium 12. As illustrated in FIG. 3, the ink head 30 includes nozzles 32 to eject the ink and a nozzle surface 32B in which the nozzles 32 are provided. The ink head 30 is accommodated in the case 34. The nozzle surface 32B is exposed to outside from a lower surface 34B of the case 34. Examples of the ink include thermosetting-type water-based ink and solvent-based ink.

As illustrated in FIG. 3, the ink head assembly 28 includes a left plate 35L and a right plate 35R. The left plate 35L is disposed to the left of the case 34 and connected to the case 34. The right plate 35R is disposed to the right of the case 34 and connected to the case 34. The left fan 33L is provided on the left plate 35L. The left fan 33L blows the air in a direction indicated by the arrow A1 in FIG. 3, i.e., obliquely downward and leftward. The left fan 33L may blow the air downward, or may blow the air obliquely downward and rightward. The right fan 33R is provided on the right plate 35R. The right fan 33R blows the air in a direction indicated by the arrow A2 in FIG. 3, i.e., obliquely downward and rightward. The right fan 33R may blow the air downward, or may blow the air obliquely downward and leftward. The left fan 33L and the right fan 33R blow the air toward the medium 12 on which the ink has been ejected. The left fan 33L and the right fan 33R blow the air to the medium 12 when the ink is ejected from the nozzles 32 onto the medium 12. The left fan 33L and the right fan 33R may stop blowing the air to the medium 12 when the ink is ejected from the nozzles 32 onto the medium 12. In the present preferred embodiment, the right fan 33R blows the air toward a later-described cap 52 (see FIG. 4). The left fan 33L may also blow the air toward the cap 52. It should be noted that in FIG. 1, the left fan 33L and the right fan 33R are not shown.

As illustrated in FIG. 1, a carriage 36 is provided on the back surface of the case 34. A recess 38 that is recessed frontward is formed in the rear side portion of the carriage 36. An engaging surface 22 engages with the recess 38. The carriage 36 is movable in a main scanning direction Y along the guide rail 18. The ink head 30 is allowed to be movable in a main scanning direction Y by the guide rail 18 via the carriage 36.

A portion of a drive belt 40, which extends along a left-right direction, is secured to an upper portion of the back surface of the case 34. The belt 40 is a looped endless belt. The drive belt 40 is connected to a scan motor 42 (see FIG. 2) and is driven to rotate by the scan motor 42. The ink head 30 is driven by the scan motor 42 via the drive belt 40. The scan motor 42 is controlled by the controller 25.

Figure 2:
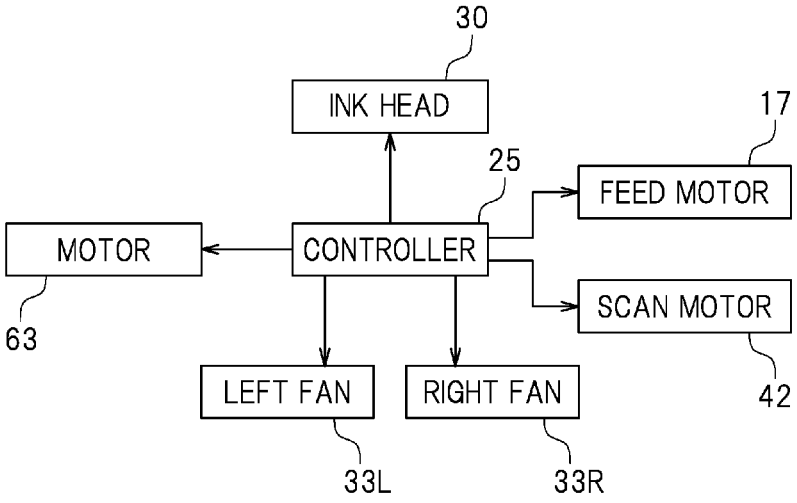
FIG. 2 is a block diagram illustrating a control system that controls the inkjet printer according to a preferred embodiment of the present invention.

As illustrated in FIG. 1, the inkjet printer 10 includes the controller 25. The configuration of the controller 25 is not particularly restricted. For example, the controller 25 may be a computer, and may include a central processing unit (hereinafter also referred to as "CPU"), a ROM to store programs or the like that are to be executed by the CPU, and a RAM. As illustrated in FIG. 2, the controller 25 is operatively connected to the left fan 33L, the right fan 33R, the feed motor 17, the scan motor 42, a later-described motor 63, and the ink head 30. The controller 25 controls the left fan 33L, the right fan 33R, the feed motor 17, the scan motor 42, and the motor 63. The controller 25 controls ejection of the ink from the nozzles 32 (see FIG. 3).

Figure 4:
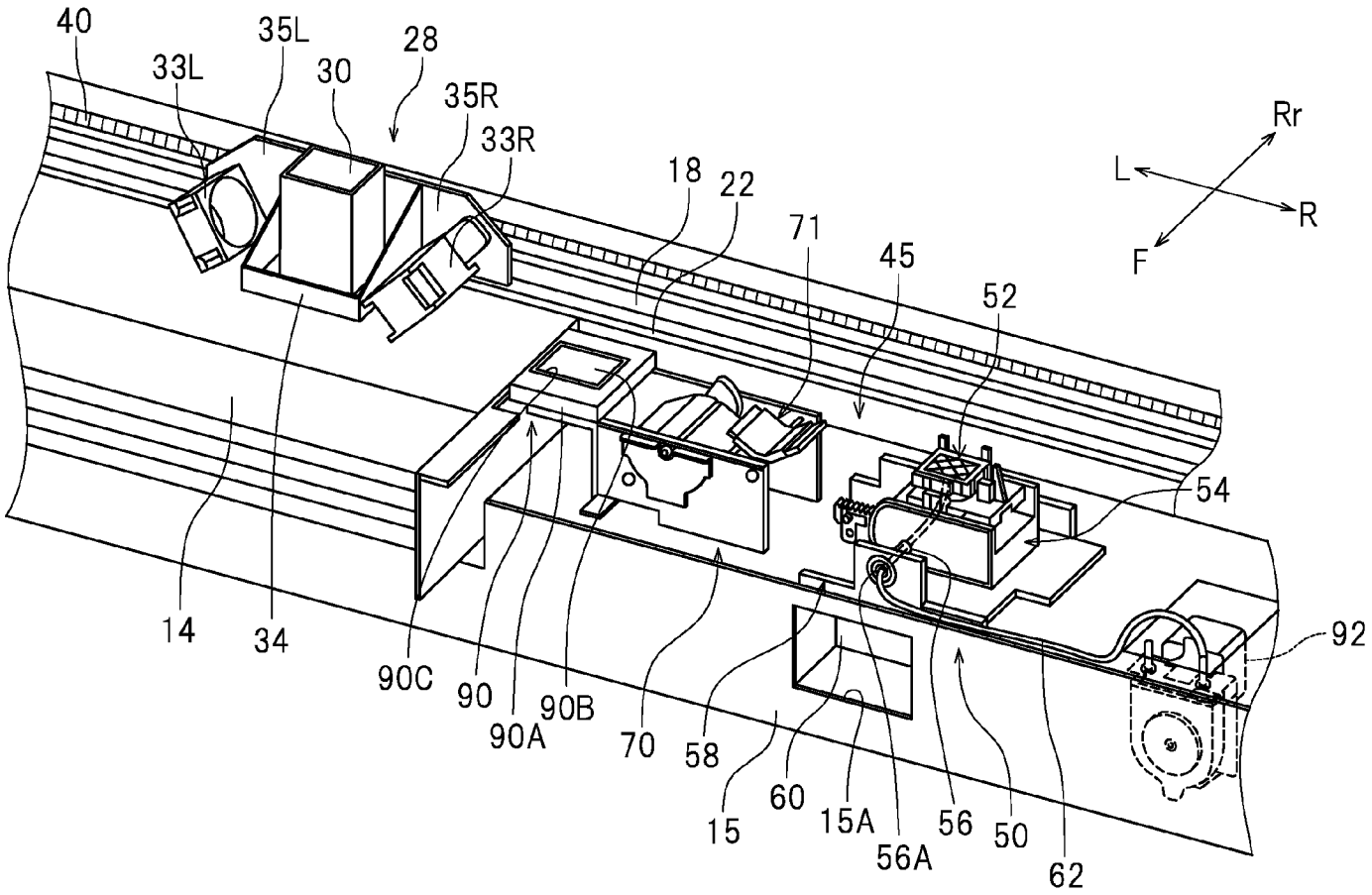
FIG. 4 is a perspective view illustrating a cleaning assembly according to a preferred embodiment of the present invention.

As illustrated in FIG. 1, the inkjet printer 10 includes a cleaning assembly 45. The cleaning assembly 45 is disposed on a side surface 15 positioned to the right of the platen 14. As illustrated in FIG. 4, the cleaning assembly 45 includes a capping assembly 50, a wiping assembly 70, and a flushing assembly 90. The capping assembly 50, the wiping assembly 70, and the flushing assembly 90 are disposed in that order from right to left, along a left-right direction. However, the arrangement order of the capping assembly 50, the wiping assembly 70, and the flushing assembly 90 is not limited thereto.

Figure 5:
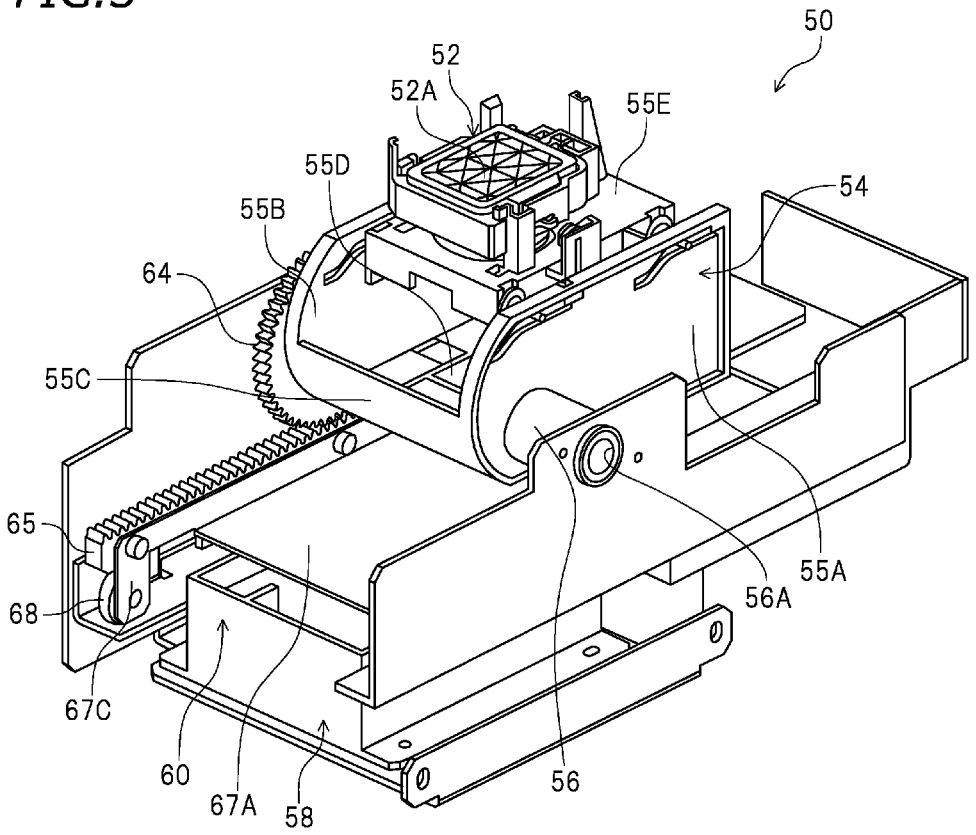
FIG. 5 is a perspective view illustrating a capping assembly according to a preferred embodiment of the present invention.

As illustrated in FIG. 5, the capping assembly 50 includes a cap 52, a support base 54, a support shaft 56, a pedestal 58, and a tank 60.

Figure 6:
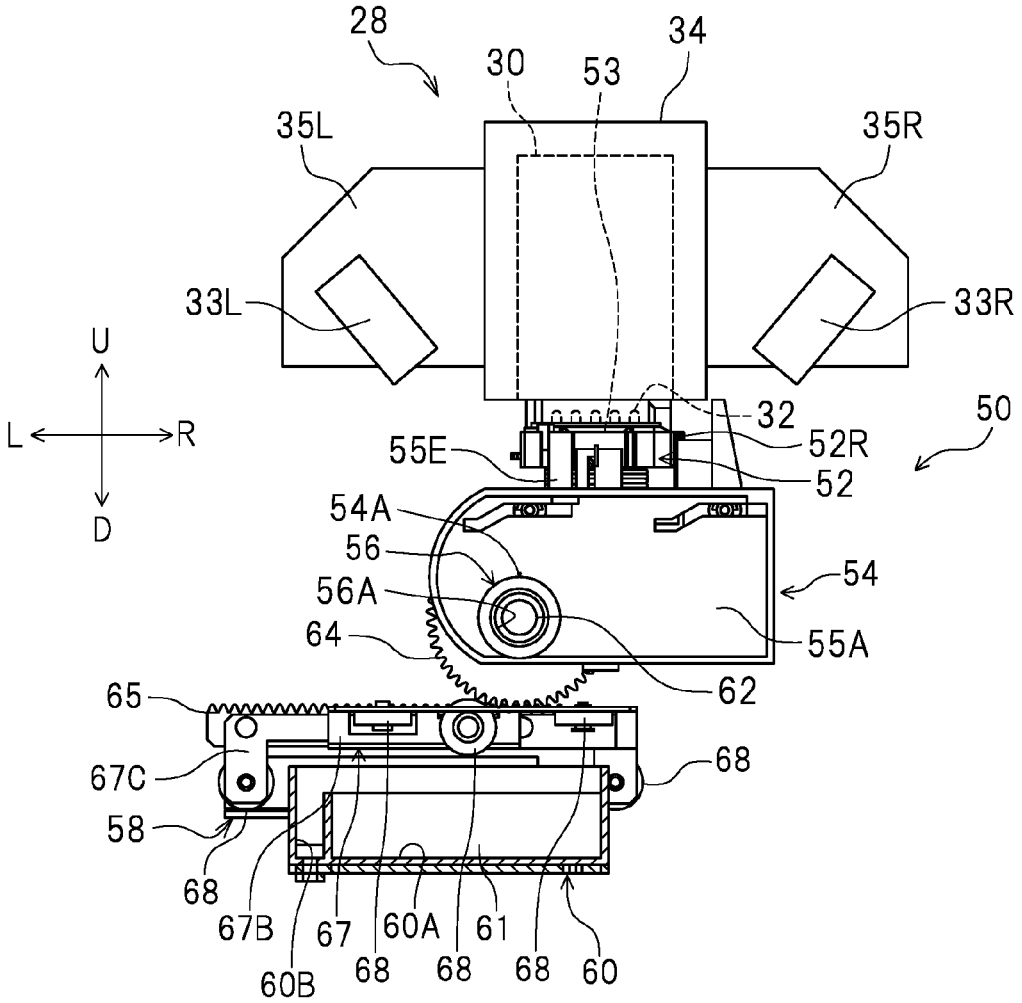
FIG. 6 is a front view illustrating how a cap is attached to the ink head assembly, according to a preferred embodiment of the present invention.

As illustrated in FIG. 5, the cap 52 includes a sponge 52A to absorb the ink sucked out of the nozzles 32 (see FIG. 3). The cap 52 is disposed on the support base 54. The cap 52 is attachable to and detachable from the ink head 30 so as to cover the nozzle surface 32B (see FIG. 3). The cap 52 is able to be attached to the ink head 30 so as to cover the nozzle surface 32B. As illustrated in FIG. 6, a sealed space 53 is defined between the cap 52 and the nozzle surface 32B when the cap 52 is attached to the ink head 30. As illustrated in FIG. 4, a suction tube 62 is connected to the cap 52. A later-described suction pump 92 is connected to the suction tube 62.

Figure 7:
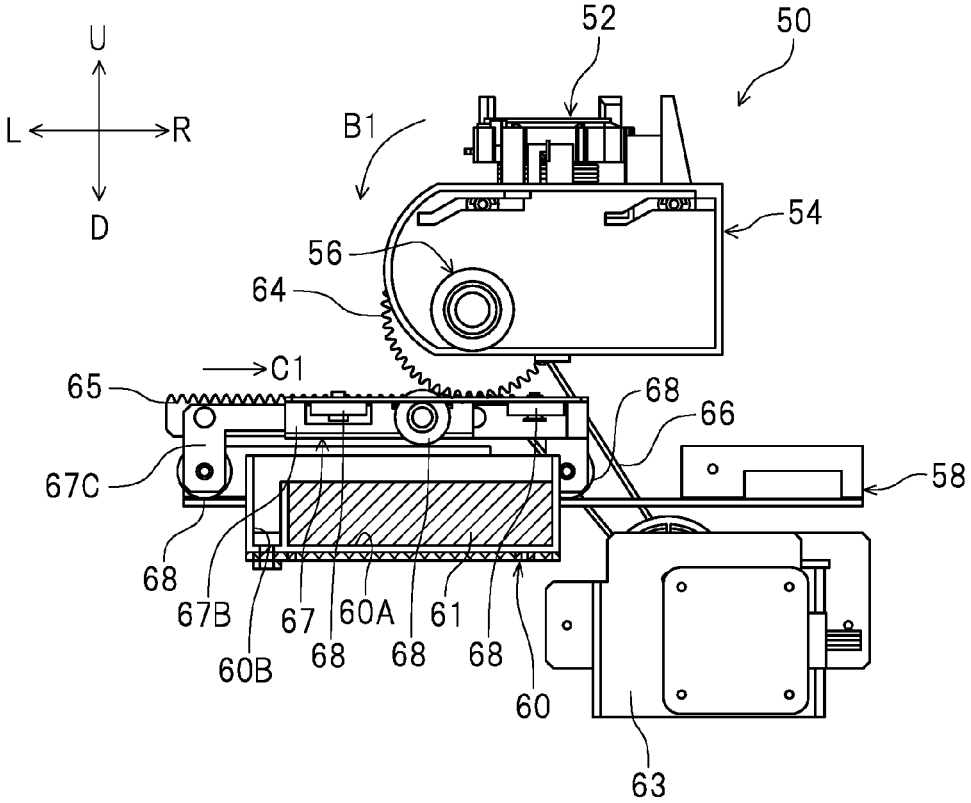
FIG. 7 is a front view illustrating the cap disposed at a capping position, according to a preferred embodiment of the present invention.
Figure 8:
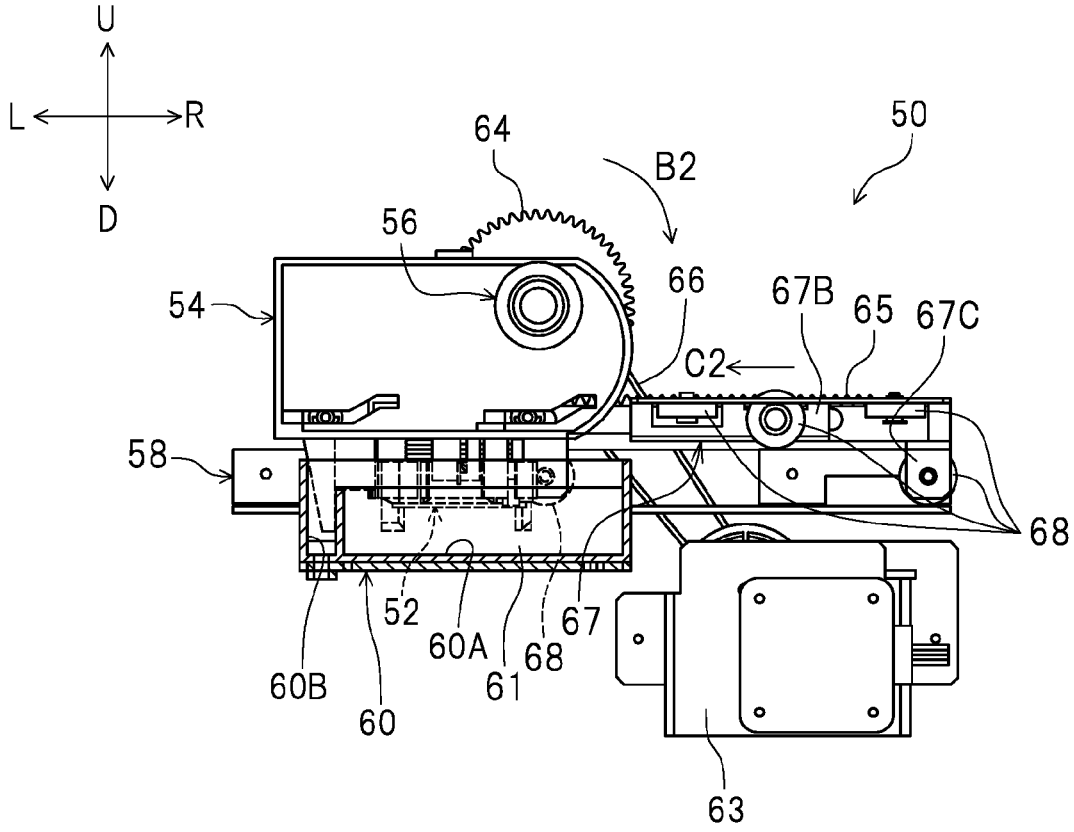
FIG. 8 is a front view illustrating the cap disposed at a cleaning position, according to a preferred embodiment of the present invention.

As illustrated in FIG. 5, the support base 54 includes a first wall 55A, a second wall 55B, a third wall 55C, and a fourth wall 55D. The second wall 55B is disposed rearward relative to the first wall 55A. The second wall 55B is disposed at a position facing the first wall 55A. The third wall 55C is disposed to the left of the first wall 55A and the second wall 55B. The third wall 55C connects a left end portion of the first wall 55A and a left end portion of the second wall 55B to each other. The fourth wall 55D is disposed at a bottom end portion of the first wall 55A and a bottom end portion of the second wall 55B. The fourth wall 55D connects the bottom end portion of the first wall 55A and the bottom end portion of the second wall 55B to each other. The support base 54 includes a cap mount 55E to which the cap 52 is mounted. The cap mount 55E is supported by the first wall 55A and the second wall 55B. The support base 54 pivots about the support shaft 56. The support base 54 pivots about the support shaft 56 in the direction indicated by the arrow B1 in FIG. 7. The support base 54 also pivots about the support shaft 56 also in the direction indicated by the arrow B2 in FIG. 8. The pivotal movement of the support base 54 causes the cap 52 to move between a capping position and a cleaning position. Herein, the term "capping position" means, as illustrated in FIG. 7, a position at which the cap 52 is positioned upward relative to the support shaft 56 and the cap 52 is able to cover the nozzles 32 (see FIG. 3). In other words, when the cap 52 is positioned at the capping position and the nozzles 32 are positioned above the cap 52, the cap 52 covers the nozzles 32; however, when the nozzles 32 are not positioned above the cap 52 although the cap 52 is positioned at the capping position, the cap 52 does not cover the nozzles 32. The term "cleaning position" means, as illustrated in FIG. 8, a position at which the cap 52 is positioned downward relative to the support shaft 56 and the cap 52 sinks in a later-described cleaning solution 61 accommodated in a later-described cleaning solution tank 60A.

As illustrated in FIG. 5, the support shaft 56 pivotably supports the support base 54. The support shaft 56 is connected to the first wall 55A of the support base 54. The support shaft 56 is rotatably supported by the pedestal 58. As illustrated in FIG. 6, when the cap 52 is at the capping position, the support shaft 56 is positioned leftward relative to the right end of the cap 52. When the cap 52 is at the capping position, the support shaft 56 is disposed downward relative to the vertically midpoint 54A of the first wall 55A. The support shaft 56 includes an insertion hole 56A extending in an axial direction. In the present preferred embodiment, the insertion hole 56A extends along a front-rear direction. The insertion hole 56A is a through-hole. As illustrated in FIG. 4, the suction tube 62 is inserted through the insertion hole 56A.

As illustrated in FIG. 4, the pedestal 58 is mounted on the side surface 15. The pedestal 58 supports the support base 54 via the support shaft 56.

As illustrated in FIG. 6, the tank 60 includes the cleaning solution tank 60A, which accommodates the cleaning solution 61, and an accommodation tank 60B, which accommodates a portion of the cap mount 55E (see FIG. 5). The cleaning solution tank 60A accommodates the cleaning solution 61. The cleaning solution 61 cleans the cap 52. The cleaning solution tank 60A is disposed at a position such that the cap 52 is able to sink in the cleaning solution 61 when the support base 54 has pivoted in the direction indicated by the arrow B1 in FIG. 7. The accommodation tank 60B is disposed at a position such that a portion of the cap mount 55E is accommodated in the accommodation tank 60B when the support base 54 has pivoted in the direction indicated by the arrow B1 in FIG. 7. The tank 60 is attachable to and detachable from the pedestal 58. As illustrated in FIG. 4, the tank 60 is able to be attached to and detached from the pedestal 58 through an opening 15A in the side surface 15.

As illustrated in FIG. 7, the inkjet printer 10 (see FIG. 1) includes the motor 63, a pinion gear 64, a rack 65, a drive belt 66, and a lid 67. The driver of the present preferred embodiment includes the motor 63 and the drive belt 66. The motor 63 is mounted to the side surface 15 (see FIG. 4). The motor 63 is mounted downward relative to the pedestal 58. The motor 63 is controlled by the controller 25 (see FIG. 2). As illustrated in FIG. 5, the pinion gear 64 is mounted to the second wall 55B of the support base 54. As illustrated in FIG. 7, the motor 63 and the pinion gear 64 are connected by the drive belt 66. That is, the drive belt 66 transmits the driving force of the motor 63 to the pinion gear 64, causing the pinion gear 64 to rotate. The pinion gear 64 and the rack 65, defining and functioning as an interlocking mechanism, mesh with each other.

As illustrated in FIG. 6, the lid 67 is structured to cover the cleaning solution tank 60A when the cap 52 is at the capping position. When the cap 52 is at the capping position, the lid 67 overlaps the cleaning solution tank 60A in a plan view. When the cap 52 is at the capping position, the lid 67 is positioned above the cleaning solution tank 60A. The lid 67 is structured not to cover the cleaning solution tank 60A when the cap 52 is at the cleaning position. When the cap 52 is at the cleaning position, the lid 67 is not positioned above the cleaning solution tank 60A. The lid 67 includes a first wall 67A (see FIG. 5) capable of covering the cleaning solution tank 60A, a second wall 67B connected to the front end of the first wall 67A, and a third wall 67C connected to the rear end of the first wall 67A. The second wall 67B is preferably provided with three bearings 68, for example, that travel on the pedestal 58. The third wall 67C is preferably provided with two bearings 68, for example, that travel on the pedestal 58. The lid 67 is provided with the rack 65 extending along a left-right direction. More specifically, the rack 65 is mounted to the third wall 67C. By driving the motor 63 (see FIG. 7), the lid 67 is allowed to move in a leftward and rightward directions on the pedestal 58.

As illustrated in FIG. 4, the inkjet printer 10 (see FIG. 1) includes a suction pump 92. The suction pump 92 is disposed inside the side surface 15. The suction pump 92 is disposed rightward relative to the cleaning assembly 45. The suction pump 92 is connected to the suction tube 62. The suction pump 92 is connected to the cap 52 via the suction tube 62. The suction pump 92 sucks out the air contained in the sealed space 53 (see FIG. 6). In other words, the suction pump 92 depressurizes the inside of the sealed space 53. This enables the ink inside the nozzles 32 of the ink head 30 to be pressurized and discharged into the cap 52, preventing the nozzles 32 from clogging.

As illustrated in FIG. 4, the wiping assembly 70 is disposed leftward relative to the capping assembly 50. The wiping assembly 70 includes a wiper 71. The wiper 71 wipes away the contaminants adhering to the nozzle surface 32B (see FIG. 3) of the nozzles 32.

As illustrated in FIG. 4, the flushing assembly 90 is disposed leftward relative to the wiping assembly 70. The flushing assembly 90 includes a case 90A and a flush paper sheet 90B. The flush paper sheet 90B is disposed at a position overlapping an opening 90C formed in the case 90A. The flush paper sheet 90B refers to a paper sheet to absorb the ink ejected from the nozzles 32 (see FIG. 3) in the flushing process of ejecting a certain amount of ink from the nozzles 32 to the flushing assembly 90.

Hereinbelow, a series of operations of capping, in which the ink in the nozzles 32 is discharged into the cap 52, will be described. As illustrated in FIG. 6, with the cap 52 being at the capping position, the ink head assembly 28 moves above the capping assembly 50, and the cap 52 is attached to the ink head 30 so as to cover the nozzle surface 32B (see FIG. 3). With the cap 52 covering the nozzle surface 32B, the suction pump 92 (see FIG. 4) is operated, so the air contained in the sealed space 53 (see FIG. 6) is sucked out, and the ink in the nozzles 32 is discharged into the cap 52. Here, as the ink in the nozzles 32 is discharged into the cap 52, the ink may solidify in the cap 52. For this reason, it is necessary to clean the cap 52 to which the ink has adhered. When cleaning the cap 52, the cap 52 is removed from the ink head 30, and the ink head assembly 28 is moved in a direction away from the capping assembly 50 (the leftward direction in the present preferred embodiment), in other words, in a direction toward the platen 14 (see FIG. 1).

Then, as illustrated in FIG. 7, when the pinion gear 64, driven by the motor 63, rotates in the direction indicated by the arrow B1 in FIG. 7, the support base 54 pivots about the support shaft 56 also in the direction indicated by the arrow B1. As the support base 54 pivots, the cap 52, which is disposed on the support base 54, moves also in the direction indicated by the arrow B1. At that time, the rack 65 moves in the direction indicated by the arrow C1 in FIG. 7 because the pinion gear 64 and the rack 65 mesh with each other. In association with the movement of the rack 65, the lid 67 also moves on the pedestal 58 in the direction indicated by the arrow C1 in FIG. 7. The lid 67, which has been positioned above the cleaning solution tank 60A so as to cover the cleaning solution tank 60A, gradually moves rightward, so that the cleaning solution tank 60A is gradually opened. As illustrated in FIG. 8, when the rotation of the pinion gear 64 is completed, the lid 67 is not positioned above the cleaning solution tank 60A, and the cap 52 is positioned at the cleaning position, at which the cap 52 sinks in the cleaning solution 61 accommodated in the cleaning solution tank 60A. In such a way, the ink adhering to the cap 52 is washed away by the cleaning solution 61.

Subsequently, as illustrated in FIG. 8, when the pinion gear 64, driven by the motor 63, rotates in the direction indicated by the arrow B2 in FIG. 8, the support base 54 pivots about the support shaft 56 also in the direction indicated by the arrow B2. As the support base 54 pivots, the cap 52, which is disposed on the support base 54, also moves in the direction indicated by the arrow B2. At that time, the rack 65 moves in the direction indicated by the arrow C2 in FIG. 8 because the pinion gear 64 and the rack 65 mesh with each other. In association with the movement of the rack 65, the lid 67 also moves on the pedestal 58 in the direction indicated by the arrow C2 in FIG. 8. The lid 67, which has been placed at the position so as not to cover the cleaning solution tank 60A, gradually moves leftward, so that the cleaning solution tank 60A is gradually closed. As illustrated in FIG. 7, when the rotation of the pinion gear 64 is completed, the lid 67 is positioned above the cleaning solution tank 60A, so the cleaning solution tank 60A is covered by the lid 67. The cap 52 is pulled up out of the cleaning solution 61 of the cleaning solution tank 60A and returned to the capping position.

When the cap 52 is pulled up out of the cleaning solution 61, the cleaning solution 61 adheres to the surface of the cap 52. Then, the controller 25 (see FIG. 2) causes the ink head assembly 28 to move in a direction toward the capping assembly 50 (in a rightward direction in the present preferred embodiment), in other words, in a direction away from the platen 14 (see FIG. 1). At that time, the controller 25 causes the ink head assembly 28 to move while driving the right fan 33R, which is mounted to the ink head assembly 28. The air blown from the right fan 33R reaches the cap 52. Thus, the cleaning solution 61 adhering to the cap 52 is blown away or evaporated by the air blown from the right fan 33R. As a result, the ink and the cleaning solution 61 are removed from the cap 52. It should be noted that the ink head assembly 28 may desirably be moved in a direction toward the capping assembly 50 while the cleaning solution tank 60A is being covered by the lid 67. It is also possible that the movement of the ink head assembly 28 may be stopped for a predetermined duration, when the ink head assembly 28 has moved to the position at which the air blown from the right fan 33R reaches the cap 52 efficiently.

The inkjet printer 10 according to the present preferred embodiment is provided with the right fan 33R, to blow air to the cap 52 after the cap 52 is pulled up out of the cleaning solution 61 accommodated in the cleaning solution tank 60A. Therefore, even if the cleaning solution 61 adheres to the cap 52 from which the ink has been removed by the cleaning solution 61, the cleaning solution 61 adhering to the cap 52 is removed by being blown away or evaporated by the air blown from the right fan 33R. As a result, it is possible to form the sealed space 53 and also prevent the cleaning solution 51 from adhering to the nozzle surface 32B, when the cap 52 is attached to the ink head 30 so as to cover the nozzle surface 32B.

In the present preferred embodiment, by driving the motor 63, the support base 54 is caused to pivot about the support shaft 56 via the drive belt 66 and the pinion gear 64. This enables the cap 52 supported by the support base 54 to move between the capping position and the cleaning position.

In the present preferred embodiment, the tank 60 is attachable to and detachable from the pedestal 58. In other words, the cleaning solution tank 60A is attachable to and detachable from the pedestal 58. This allows easy replacement of the cleaning solution 61 accommodated in the cleaning solution tank 60A.

In the present preferred embodiment, the suction tube 62, which is connected to the cap 52 and the suction pump 92, is inserted through the insertion hole 56A formed in the support shaft 56, as illustrated in FIG. 4. Therefore, the suction tube 62, which is connected to the cap 52 mounted to the support base 54, does not interfere with the support base 54 even when the support base 54 pivots about the support shaft 56. This makes it possible to prevent the suction tube 62 from being worn off by the pivotal movement of the support base 54.

In the present preferred embodiment, when the cap 52 is at the capping position, as illustrated in FIG. 6, the lid 67 is positioned above the cleaning solution tank 60A. In other words, the lid 67 covers the cleaning solution tank 60A. This makes it possible to prevent evaporation of the cleaning solution 61 accommodated in the cleaning solution tank 60A. Moreover, because the air blown from the right fan 33R is blocked by the lid 67 so that it does not to reach the cap 61, the cleaning solution 61 can be prevented from spilling out of the cleaning solution tank 60A.

In the present preferred embodiment, when the cap 52 is at the cleaning position, as illustrated in FIG. 8, the lid 67 is not positioned above the cleaning solution tank 60A. In other words, the lid 67 does not cover the cleaning solution tank 60A. On the other hand, when the cap 52 is at the capping position, as illustrated in FIG. 7, the lid 67 is positioned above the cleaning solution tank 60A. In other words, the lid 67 covers the cleaning solution tank 60A. Thus, the cleaning solution 61 is exposed to the atmosphere only when the cap 52 is cleaned with the cleaning solution 61. Therefore, it is possible to prevent evaporation of the cleaning solution 61 more reliably.

In the present preferred embodiment, as illustrated in FIG. 5, the capping assembly 50 preferably includes the pinion gear 64, mounted to the support base 54, and the rack 65, mounted to the lid 67 and meshing with the pinion gear 64. Thus, both the pivotal movement of the support base 54 and the movement of the lid 67 are able to be performed at the same time by driving the motor 63 to rotate the pinion gear 64.

In the present preferred embodiment, the ink head 30, the right fan 33R, and the left fan 33L are mounted to the carriage 36. This enables the ink head 30, the right fan 33R, and the left fan 33L to move unitarily.

In the present preferred embodiment, the right fan 33R blows air to the medium 12 when the ink is ejected from the nozzles 32 onto the medium 12. Thus, when printing is performed on the medium 12, the right fan 33R is able to be used to dry the ink that has been ejected onto the medium 12. When printing is not performed on the medium 12, the right fan 33R is able to be used to remove the cleaning solution 61 adhering to the cap 52.

In the foregoing preferred embodiment, the right fan 33R to blow the air to the cap 52 preferably is mounted to the ink head assembly 28, but this is merely illustrative. It is also possible to provide another fan to blow the air to the cap 52 on the side surface 15.

In the foregoing preferred embodiment, the cap 52 preferably is allowed to move between the capping position and the cleaning position by causing the support base 54 to pivot about the support shaft 56, but this is merely illustrative. For example, it is also possible that the cap 52 may be allowed to move between the capping position and the cleaning position by causing the cap 52 to move in upward and downward directions.

In the foregoing preferred embodiment, both the pivotal movement of the support base 54 and the movement of the lid 67 preferably are performed by the motor 63, but this is merely illustrative. It is also possible to provide a motor to pivot the support base 54 and another motor to move the lid 67 independently.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet printer comprising:

an ink head including a plurality of nozzles to eject ink and a nozzle surface in which the nozzles are provided;

a cap attachable to and detachable from the ink head to cover the nozzle surface and to provide a sealed space between the cap and the nozzle surface when attached to the ink head;

a suction pump to suck out air contained in the sealed space;

a cleaning solution tank to accommodate a cleaning solution to clean the cap; and a driver causing the cap to move between a capping position, at which the cap covers the nozzle surface, and a cleaning position, at which the cap sinks in the cleaning solution accommodated in the cleaning solution tank.

2. The inkjet printer according to claim 1, further comprising:

a fan to blow air to the cap.

3. The inkjet printer according to claim 2, further comprising:

a movable carriage on which the ink head and the fan are mounted.

4. The inkjet printer according to claim 3, wherein the fan blows air to a medium receiving the ink when the ink is ejected from the nozzles onto the medium.

5. The inkjet printer according to claim 1, further comprising:

a support base that supports the cap; and a support shaft that pivotably supports the support base; wherein the driver causes the support base to pivot about the support shaft.

6. The inkjet printer according to claim 5, further comprising:

a pedestal that supports the support base; wherein the cleaning solution tank is attachable to and detachable from the pedestal.

7. The inkjet printer according to claim 5, wherein:

the support shaft includes an insertion hole extending in an axial direction; and the inkjet printer further comprises a tube inserted through the insertion hole and connected to the cap and the suction pump.

8. The inkjet printer according to claim 5, further comprising a lid positioned above the cleaning solution tank when the cap is positioned at the capping position.

9. The inkjet printer according to claim 8, further comprising an interlock causing the lid to move in association with pivotal movement of the support base so that the lid is not positioned above the cleaning solution tank when the cap is positioned at the cleaning position and that the lid is positioned above the cleaning solution tank when the cap is positioned at the capping position.

10. The inkjet printer according to claim 9, wherein the interlock includes:

a first gear mounted to the support base and rotating in association with pivotal movement of the support base; and a second gear mounted to the lid and meshing with the first gear to move the lid in association with rotation of the first gear.

* * * * *